United States Patent [19]

Nishite et al.

[11] Patent Number: 4,763,493

[45] Date of Patent: Aug. 16, 1988

[54] ELECTRONIC DRIVING-TYPE DISPLAY APPARATUS FOR AN ELECTRIC WASHING MACHINE

[75] Inventors: Yoshitoyo Nishite, Yokohama; Fumio Torita, Nagoya; Naotaka Ikeda, Kasugai, all of Japan

[73] Assignee: Kabushiki Kaisha Toshiba, Kawasaki, Japan

[21] Appl. No.: 940,078

[22] Filed: Dec. 10, 1986

[30] Foreign Application Priority Data

Dec. 18, 1985 [JP] Japan ..... 60-285192

[51] Int. Cl.[4] ..... D06F 33/02

[52] U.S. Cl. ..... 68/12 R; 340/286 M; 340/309.15; 340/525

[58] Field of Search ..... 68/12 R; 134/113; 340/525, 286 M, 309.15, 309.3, 309.4

[56] References Cited

U.S. PATENT DOCUMENTS

| | | | |
|---|---|---|---|
| 4,195,500 | 4/1980 | Tobia et al. | 68/12 R |
| 4,555,694 | 11/1985 | Yanagishima et al. | 340/286 M X |
| 4,676,077 | 6/1987 | Hirooka et al. | 68/12 R |

FOREIGN PATENT DOCUMENTS

| | | | |
|---|---|---|---|
| 49-35572 | 3/1974 | Japan . | |
| 96 | 1/1984 | Japan | 68/12 R |
| 2112554 | 7/1983 | United Kingdom | 68/12 R |

OTHER PUBLICATIONS

Hitachi Full Automated Washing Machine KW-35LX--placed on the market in Sep. 1984.

*Primary Examiner*—Philip R. Coe

*Attorney, Agent, or Firm*—Cushman, Darby & Cushman

[57] ABSTRACT

An electronic driving-type status display apparatus for an electric washing machine comprises a display control circuit for outputting display signals of the progress of the washing operation and abnormalities and a display which has an electronic driving-type display element driven by the display signal from the display control circuit to display the progress of the washing operation and abnormalities. The apparatus is particularly suitable for an electronically-controlled washing machine and can display abnormalities of the washing operation without any errors.

5 Claims, 9 Drawing Sheets

FIG. 4

| CYCLES | PATTERNS OF DISPLAY |
|---|---|
| WATER SUPPLY | A, B, H |
| WASH | B, C, D, E, I, |
| DRAINAGE | B, F, J, |
| DEHYDRATION | B, G, K, |
| WATER SUPPLY | A, B, H, |
| RINSE | (A), B, C, D, L, (M), |
| DRAINAGE | B, F, J, |
| DEHYDRATION | B, G, K, |

ELECTRONIC DRIVING-TYPE DISPLAY APPARATUS FOR AN ELECTRIC WASHING MACHINE

BACKGROUND OF THE INVENTION

This invention relates to an electronic driving-type display apparatus for an electric washing machine and, more particularly, to an electronic driving-type status display apparatus for an electric washing machine in which the progress and abnormalities of the washing operation are displayed on a display consisting of electronic driving-type display elements so as to be suitable for a so-called "automatic" or electronically controlled washing machine.

Conventionally, some electric washing machines display the progress of the washing operation. An example of such a display apparatus is disclosed in Japanese Utility Model Disclosure No. 49-35572. In this apparatus, a plurality of panel plates are located on a rotating shaft which is rotated in one direction. The panel plates have names of various cycles (WATER SUPPLY, WASH, DRAINAGE, DEHYDRATION, and the like) during the washing operation and figures for illustrating these processes thereon. The rotating shaft is rotated in one direction at predetermined angular intervals in accordance with the progress of the washing operation. Therefore, the panel plates corresponding to the above cycles sequentially appear at a front display position of the washing machine.

However, the display apparatus with the above arrangement has the following drawbacks:

(a) In the above arrangement, a large number of panel plates must be mounted on a single rotating shaft. In addition, the above arrangement is a mechanical one which requires a rotating plate for detecting a rotational angular position of the rotating shaft and a control member for locking the panel plates at a predetermined front display position. Such an arrangement is liable to malfunction, is mechanically controlled, and hence is not suitable for recent developments in electronically-controlled washing machines.

(b) In the above arrangement, the panels corresponding to the respective cycles are caused to sequentially appear at the front display position by the rotating shaft which is rotated in one direction. Accordingly, display contents are limited to the sequence of the names of the cycles determined by rotation of the shaft in one direction, so that any one of the display contents and the order in which it appears cannot be easily changed.

On the other hand, various functions have been recently provided for electronically-controlled washing machines. For example, process cycles can be set arbitrarily by a user, or abnormalities can be detected during a drainage or dehydration process in some washing machines. It is proposed to use the above-mentioned conventional display apparatus in such electronically-controlled washing machines. For example, a process cycle set by the user may be displayed on the conventional display apparatus. In order to cause the panel plate corresponding to the cycle set by the user to appear at the front display position, since the panel plates are arranged according to the time sequence, other panel plates sometimes must be rotated rapidly by the rotating shaft. Therefore, it sometimes takes a long time for the proper display to appear.

In addition, abnormalities detected during the drainage or dehydration process may be displayed by the conventional display apparatus. In this case, a panel plate displaying "DRAINAGE ABNORMALITY" thereon may be positioned next to a panel plate displaying "DEHYDRATION CYCLE", or a panel plate displaying "DRAINAGE ABNORMALITY" may be positioned next to a panel plate displaying "DEHYDRATION CYCLE". However, since the panel plates appear in a predetermined order upon shaft rotation in one direction, "DRAINAGE ABNORMALITY" is displayed temporarily when there is no abnormality for drainage or dehydration. As a result, abnormalities may be erroneously recognized.

SUMMARY OF THE INVENTION

It is, therefore, an object of the present invention to provide a new and improved electronic driving-type status display apparatus for an electric washing machine which will not easily malfunction, in which display contents of the progress of the washing operation are not limited in respect to time, and in which abnormalities of the washing operation can be correctly displayed without error and inconvenience to the operator.

According to the present invention, there is provided an electronic driving-type display apparatus for an electric washing machine comprising display control means for sequentially outputting first display data during a washing operation by a washing machine main body, for dividing the washing operation into a predetermined number of processes and displaying them and for outputting second display data when an abnormality occurs during the washing operation by the washing machine main body, and for displaying the abnormality in correspondence with the process cycles, and display means which has an electronic driving-type display including a predetermined number of patterns of display for selectively displaying the predetermined number of process cycles and abnormality and for receiving the first and second display data from the display control means and driving the patterns of the display corresponding to the received first and second display data.

BRIEF DESCRIPTION OF THE DRAWINGS

These and other objects and features of the present invention can be understood through the following embodiments by reference to the accompanying drawings, in which:

FIGS. 1 to 6 are views showing the first embodiment of the present invention, wherein:

FIG. 1 is a front view of a fluorescent display,

FIG. 2 is a perspective view of an essential part of a washing machine,

FIG. 3 is a block diagram of the washing machine display control circuitry,

FIG. 4 is a view showing process cycles of a "fully automatic course" together with their patterns of display.

FIGS. 7, 8A to 8F, 9A and 9B are views showing the second embodiment of the present invention, wherein:

FIG. 7 is a block diagram substantially corresponding to FIG. 3,

FIGS. 8A to 8F are views corresponding to FIGS. 5A to 5G except 5E, respectively, and FIGS. 9A and 9B are views corresponding to FIGS. 6A and 6B.

DETAILED DESCRIPTION OF THE PREFERRED EMBODIMENTS

Figure 1:
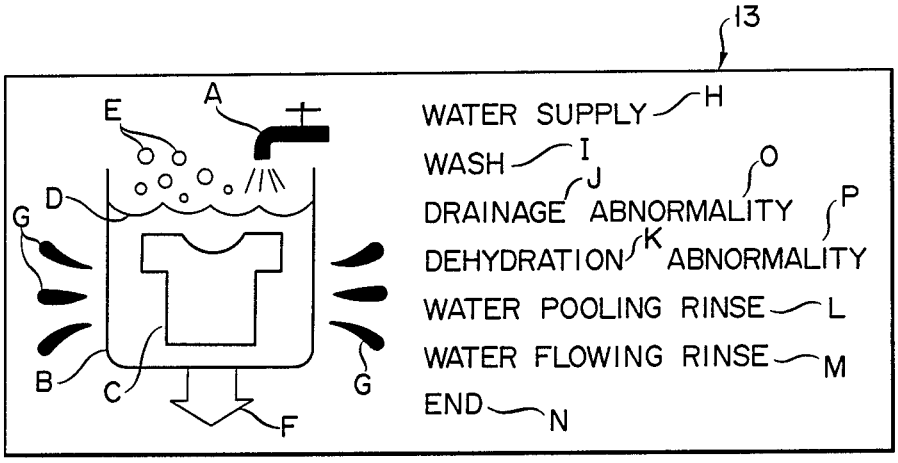
Figure 2:
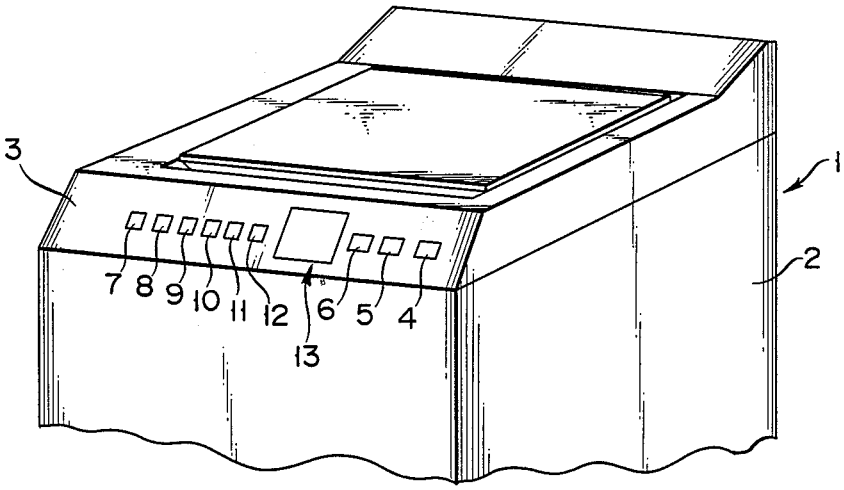

The first embodiment of the present invention will now be described in detail with reference to FIGS. 1 to 6. In FIG. 2, reference numeral 1 denotes a washing machine main body; 2, its casing; and 3, a control panel provided on an upper surface of casing 2. Power switch 4, first start switch 5 (which also serves as a "standard course" selecting switch), second start switch 6 (which also serves as an "economy course" selecting switch), course selecting switch 7 for a "fully automatic course", course selecting switch 8 for a "wash only course", course selecting switch 9 for a "wash/rinse course", course selecting switch 10 for a "rinse/dehydration course", course selecting switch 11 for a "dehydration only course", rinse change switch 12, and fluorescent display 13 are arranged on panel 3. Using the above switches 5 to 12, a user selects a desired washing course from among a predetermined number of washing programs which are prestored in washing drive/display control circuit 14 to be described later.

When switch 7 for the "fully automatic course" is operated, the "fully automatic course" shown in FIG. 4 is selected and set. In the "fully automatic course", "water supply", "wash", "drainage", "dehydration", "water supply", "rinse", "drainage", and "dehydration" processes are sequentially executed. In this case, when the washing operation is started upon operation of switch 5, the "fully automatic course" is executed by the "standard course". When switch 6 is operated, the "fully automatic course" is executed by an "economy course" in which "wash", "rinse", and "dehydration" times are slightly short. Note that when switches 8 to 11 are operated, corresponding courses are selected. In any case, either the "standard course" or the "economy course" is set and executed for each course upon operation of switch 5 or 6. A "water pooling rinse course" is set upon a first operation of switch 12 and a "water flowing rinse course" is set upon a second operation thereof.

Display 13 will be described below. Display 13 consists of an electronic driving-type fluorescent display element as a display element. This fluorescent display element has a structure equivalent to that of a directly heated triode, in which a fine filament, a mesh-like grid, and a display anode coated with a phosphor are sequentially arranged on a display surface. In the fluorescent display element, thermionic emission is caused upon application of a filament voltage, and the thermions bombard against the phosphor to emit light upon application of voltages on the grid and the anode. The above phosphor is coated with various patterns of display. The patterns of display are, as shown in FIG. 1, figure display pattern A symbolizing a water supply valve and water supplied therefrom; B, a tub; C, cloth; D, water in the tub; E, detergent bubbles; F, water being drained from the tub; and G, water during dehydration, together with character display pattern H showing "WATER SUPPLY"; I, "WASH"; J, "DRAINAGE"; K, "DEHYDRATION"; L, "WATER POOLING RINSE"; M, "WATER FLOWING RINSE"; N, "END"; and O and P, "ABNORMALITY" corresponding to the above patterns J of "DRAINAGE" and K of "DEHYDRATION", respectively. In display 13, when a voltage is applied to the grid and the anode corresponding to the specific display pattern, its phosphor emits light.

Figure 3:
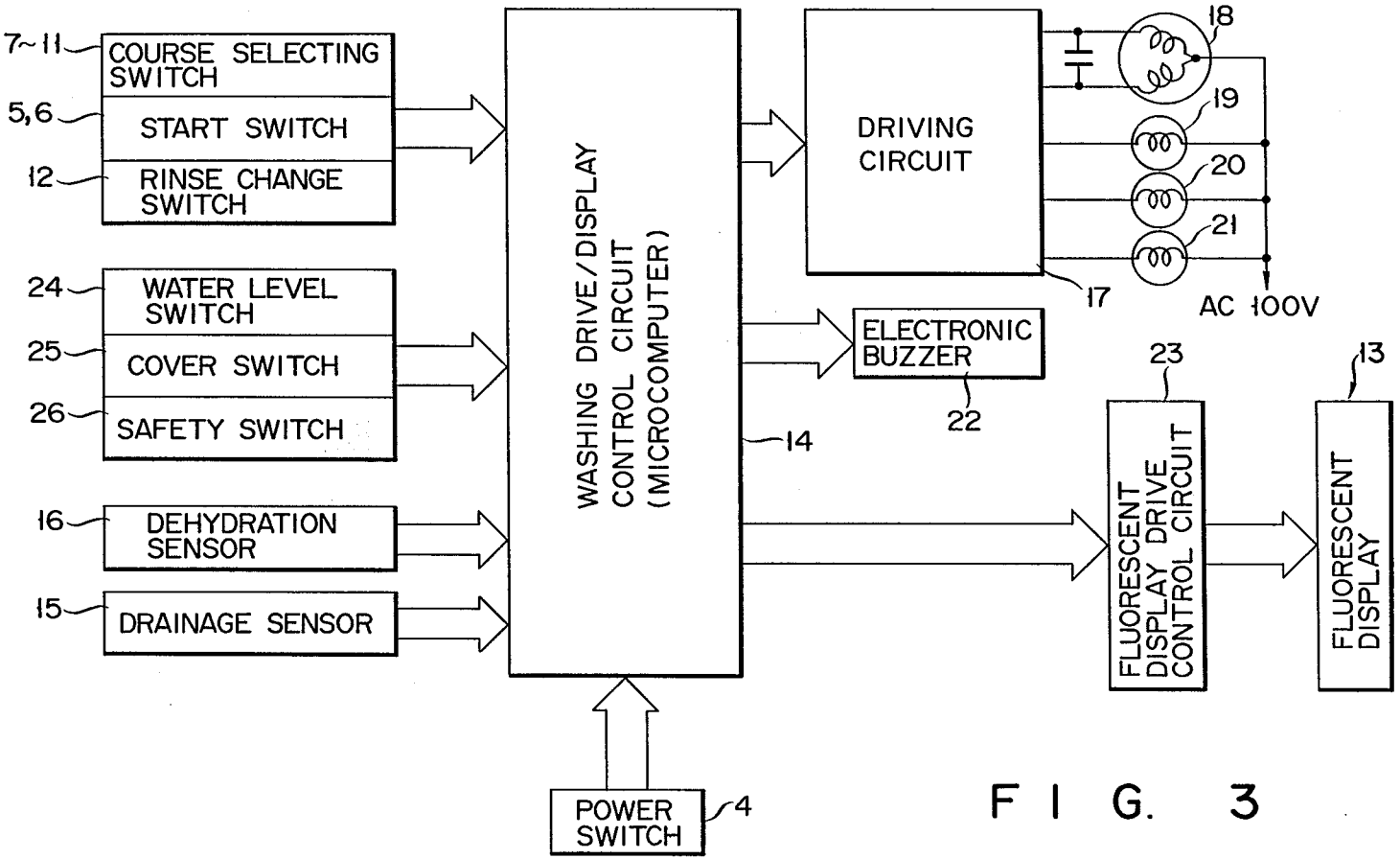

In FIG. 3, reference numeral 14 denotes a washing drive/display control circuit which is also used as a display control circuit; 15, a drainage sensor, provided to body 1, for detecting whether drained water is present and supplying a detection signal to circuit 14; 16, a dehydration sensor, also provided to body 1, for detecting an imbalance of clothes to be dehydrated during dehydration and supplying a detection signal to circuit 14; and 17, a drive circuit for receiving a drive control signal from circuit 14, which drives motor 18 for rotating a tub for wash and dehydration and an agitator (not shown), drainage valve 19, water supply valve 20, and magnet 21 for supplying a softening agent. Reference numeral 22 denotes an electronic buzzer for generating a sound at the end of the washing operation, which is driven by circuit 14; 23, a fluorescent display drive control circuit which is operated by display data output from circuit 14 in different modes and drives display 13, so that display 13 displays a predetermined pattern of display; 24, a well-known water level switch; 25, a cover switch; and 26, a safety switch. Reference numerals 4 to 12 denote the switches described above.

Circuit 14 causes body 1 to execute a washing operation according to a washing course, among a predetermined number of prestored washing programs, corresponding to operation of switches 5 to 12. In this case, circuit 14 causes display 13 to display the progress of the washing operation, i.e., the progress of the processes being operated, and to display an abnormality when there is an abnormality in the drainage or dehydration processes. This will be described in detail below. For example, when the "fully automatic course" is selected and the "standard course" is selected and set for it, the washing operation is executed sequentially from the "water supply" cycle as shown in FIG. 4. In this case, display patterns illuminated in display 13 correspond to respective processes, as shown in FIG. 4 and FIGS. 5A to 5I. Note that in FIG. 5J, a display pattern corresponding to the end of the processes is shown.

Figure 5A:
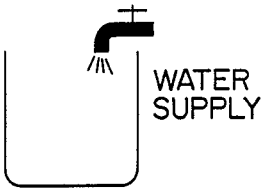
FIGS. 5A to 5J and FIGS. 6A and 6B are views showing patterns of display for explaining their operations.
Figure 5F:
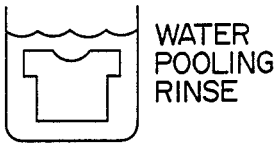
Figure 5G:
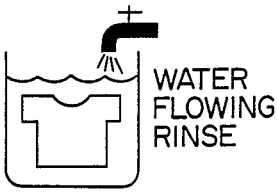
Figure 5B:
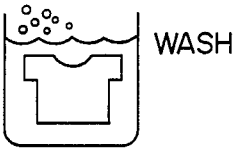
Figure 5H:
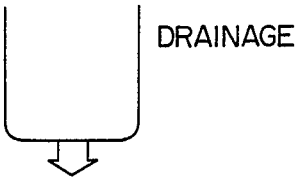
Figure 5C:
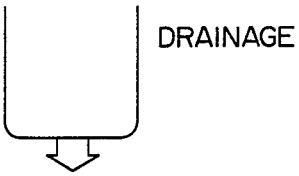
Figure 5I:
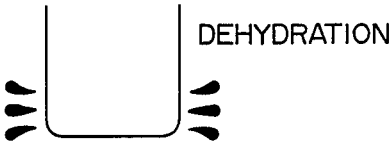
Figure 5D:
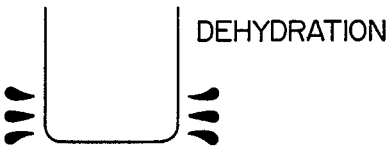
Figure 5J:
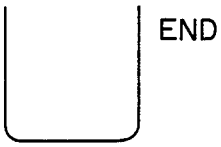
Figure 5E:
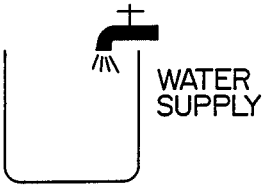

In each "water supply" cycle, display 13 is driven to display figure display patterns A and B and character display pattern H by display data from circuit 14, as shown in FIG. 4 and FIGS. 5A and 5E. In the "wash" cycle, as shown in FIGS. 4 and 5B, display 13 is driven to display figure display patterns B, C, D, and E and character display pattern I. In the "drainage" cycle, as shown in FIG. 4 and FIGS. 5C and 5H, display 13 is driven to display figure display patterns B and F and character display pattern J. In the "dehydration" cycle, as shown in FIG. 4 and FIGS. 5D and 5I, display 13 is driven to display figure display patterns B and G and character display pattern K. In the "rinse" cycle, when the "water pooling rinse course" is selected and set for the "rinse" process, display 13 is driven to display figure display patterns B, C, and D and character display pattern L, as shown in FIG. 5G. When the "water flowing rinse course" is selected and set, display 13 is driven to display figure display patterns A, B, C, and D and character display pattern M. When the "dehydration only course" is selected and set, "drainage" and "dehydration" processes are sequentially executed. In this case, patterns of display in FIGS. 5H, 5I, and 5J are sequentially displayed on display 13.

Figure 6A:
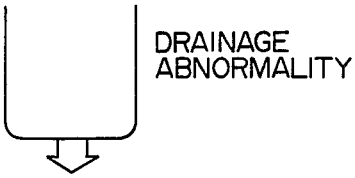
Figure 6B:
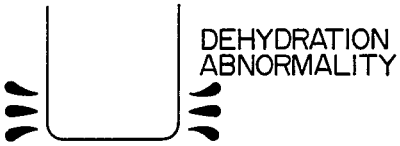

On the other hand, when an abnormality in which drainage is not performed is detected in each "drainage" cycle described above, a display signal of an output mode different from that of the above described display signals is supplied from circuit 14 to circuit 23 according to the detection signal of sensor 15. As a result, display 13 is driven by circuit 23 to display character display pattern O for displaying "ABNORMALITY", together with figure display patterns B and F and character display pattern J, thereby displaying an abnormality of drainage, as shown in FIGS. 1, 4 and 6A. When there is an abnormality in which an imbalance of clothes to be dehydrated occurs in each "dehydration" cycle, display 13 is driven to display character display pattern P for displaying "ABNORMALITY", together with figure display patterns B and G and character display pattern K, thereby displaying an abnormality of dehydration, as shown in FIGS. 1, 4, and 6B.

According to the above embodiment of the present invention, the progress of the washing operation is displayed by display 13 consisting of a so-called electronic driving-type fluorescent display element which is driven by electronic control. Therefore, unlike the conventional display apparatus having the mechanical structure described above, the electronic driving-type display apparatus does not easily malfunction, can be easily controlled, and hence is very suitable for an electronically-controlled washing machine. In addition, circuit 14 causes display 13 to display an abnormality together with the progress described above, thereby conveniently indicating the abnormality. In this display apparatus according to the above embodiment, unlike the conventional display apparatus described above, the display content is not limited to the time sequence and hence any given process can be displayed. Therefore, when the display apparatus according to the above embodiment is adopted in an electronically-controlled washing machine in which the operation processes are set by the user, it can immediately display the process set by the user irrespective of the time order with respect to the other processes. In addition, unlike the conventional display apparatus described above, the display apparatus according to the above embodiment does not display "ABNORMALITY" even temporarily when there is no abnormality but can display "ABNORMALITY" only when there is an abnormality. Therefore, the user will not be erroneously informed of an abnormality.

Figure 7:
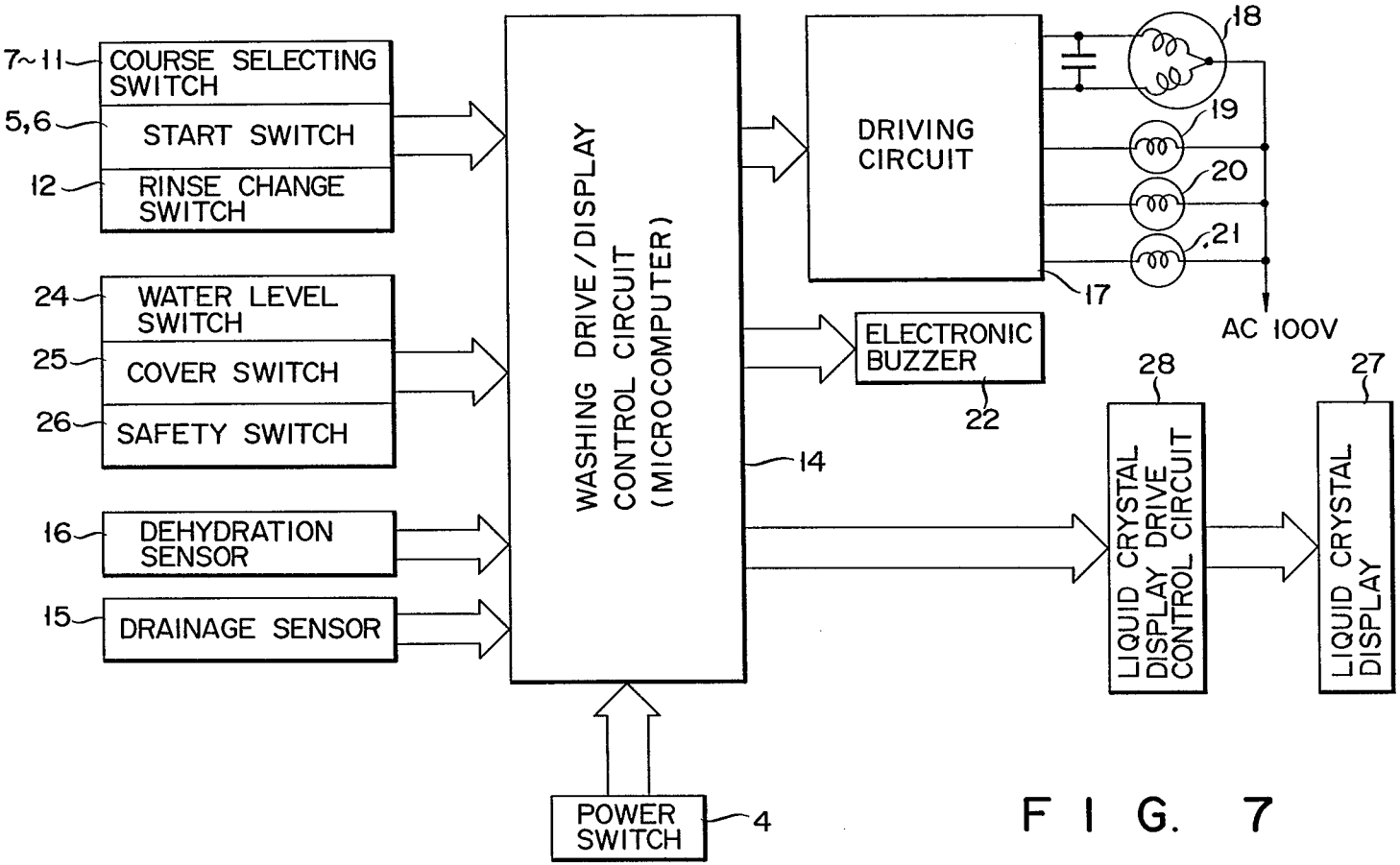

A second embodiment of the present invention will now be described in detail with reference to FIGS. 7 to 9. Note that the same parts as in FIG. 3 are denoted by the same reference numerals in FIG. 7, and a detailed description thereof will be omitted. In FIG. 7, reference numeral 27 denotes a liquid crystal display consisting of an electronically-driven liquid crystal display element, and numeral 28 denotes liquid crystal display drive control circuit, operated by display data including remaining time display data from circuit 14 which is also used as a display control circuit, for causing display 27 to display predetermined patterns of display. The patterns of display will be described with reference to FIGS. 8A to 8F.

Figure 8A:
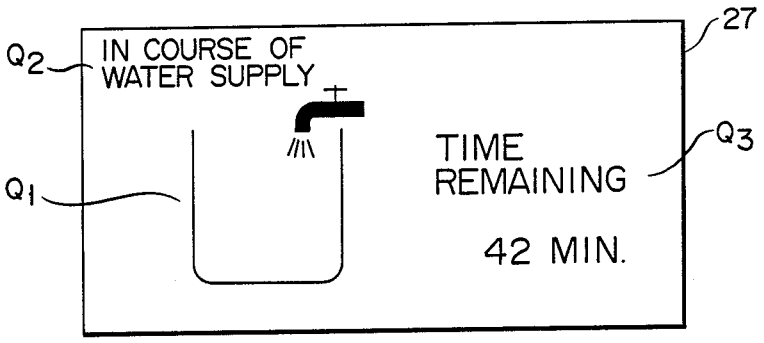
Figure 8B:
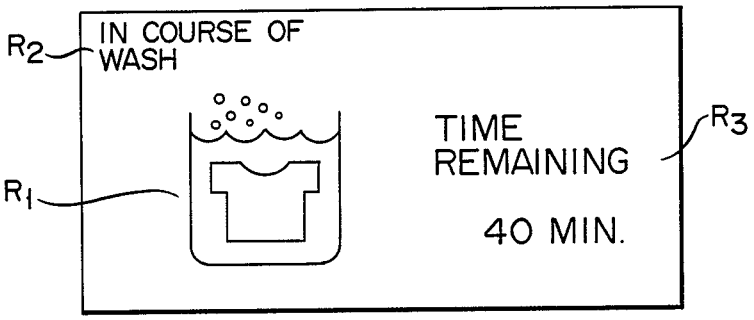
Figure 8C:
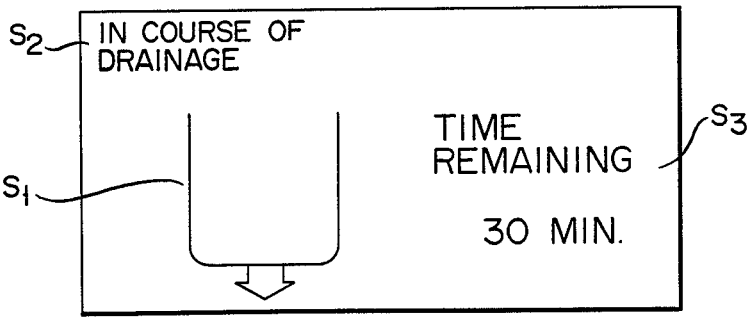
Figure 8D:
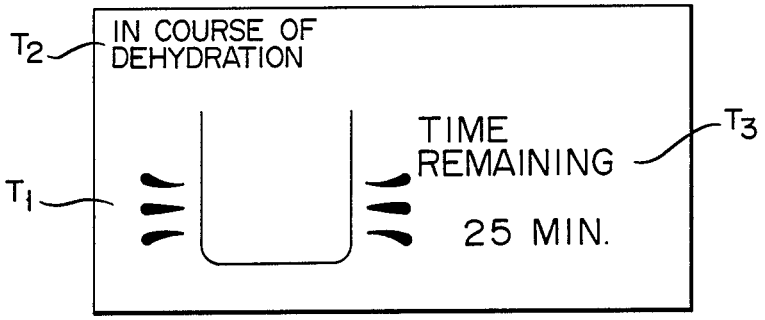
Figure 8E:
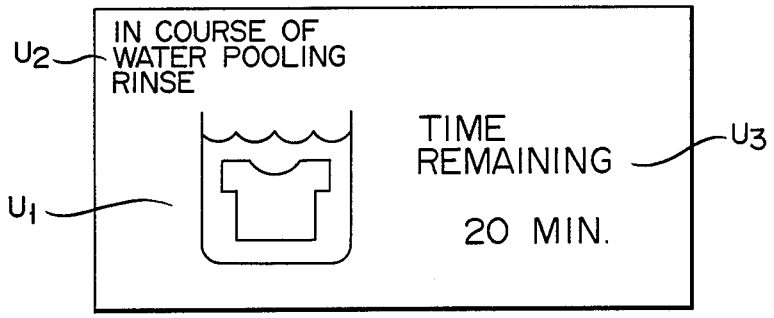
Figure 8F:
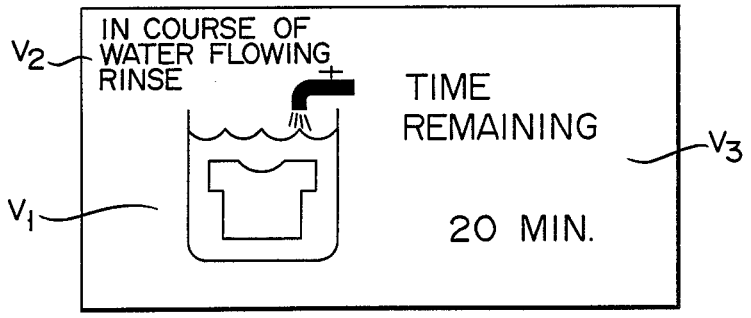
Figure 9A:
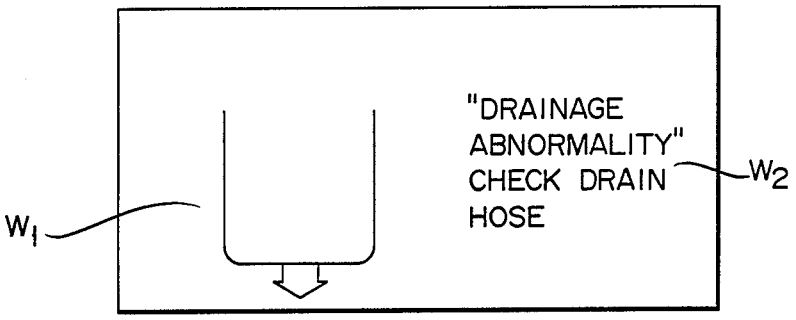
Figure 9B:
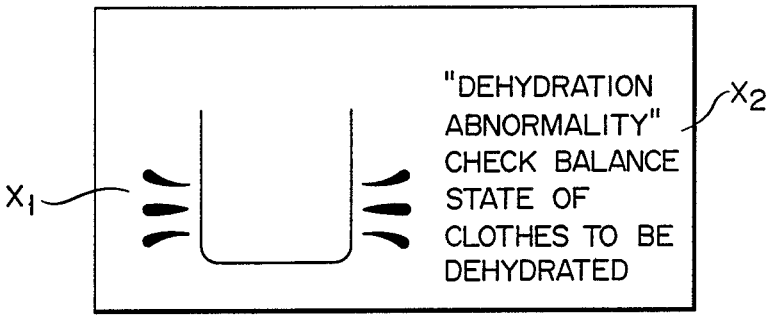

In the "water supply" cycle, as shown in FIG. 8A, figure display pattern $Q_1$ symbolizing the water supply valve and water supplied therefrom, character display pattern $Q_2$ of "IN COURSE OF WATER SUPPLY", and numeral display pattern $Q_3$ for displaying a remaining time of the washing operation, e.g., "TIME REMAINING 42 MIN" are displayed. In the "wash" cycle, as shown in FIG. 8B, figure display pattern $R_1$ symbolizing a tub, water in the tub, cloth, and detergent bubbles, character display pattern $R_2$ of "IN COURSE OF WASH", and numeral display pattern $R_3$ for displaying a remaining time are displayed. In the "drainage" cycle, as shown in FIG. 8C, figure display pattern $S_1$ symbolizing the tub and water drained therefrom, character display pattern $S_2$ of "IN COURSE OF DRAINAGE", and numeral display pattern $S_3$ for displaying a remaining time are displayed. In the "dehydration" cycle, as shown in FIG. 8D, figure display pattern $T_1$ symbolizing the tub and water scattered therefrom during dehydration, character display pattern $T_2$ of "IN COURSE OF DEHYDRATION", and numeral display pattern $T_3$ for displaying a remaining time are displayed. In the "rinse" cycle, when the "rinse" process is the "water pooling rinse course", figure display pattern $U_1$ symbolizing the tub and water and cloth therein, character display pattern $U_2$ of "IN COURSE OF WATER POOLING RINSE", and numeral display pattern $U_3$ for displaying a remaining time are displayed, as shown in FIG. 8E. When the "rinse" cycle is the "water flowing rinse course", figure display pattern $V_1$ symbolizing the water supply valve and water supplied therefrom together with above pattern $U_1$, character display pattern $V_2$ of "IN COURSE OF WATER FLOWING RINSE", and numeral display pattern $V_3$ for displaying a remaining time are displayed, as shown in FIG. 8F. When an abnormality is detected in the "drainage" process, figure display pattern $W_1$ similar to pattern $S_1$ shown in FIG. 8C and character display pattern $W_2$ of "DRAINAGE ABNORMALITY, CHECK DRAIN HOSE" is displayed on display 27, as shown in FIG. 9A. On the other hand, when an abnormality is detected in the "dehydration" process, figure display pattern $X_1$ similar to pattern $T_1$ shown in FIG. 4D and character display pattern $X_2$ of "DEHYDRATION ABNORMALITY, CHECK BALANCE STATE OF CLOTHES TO BE DEHYDRATED" is displayed, as shown in FIG. 9B.

The second embodiment has the same effect as that of the first embodiment described above. More specifically, according to the second embodiment, a detailed display can be advantageously obtained by used of a liquid crystal display.

Figure 10:
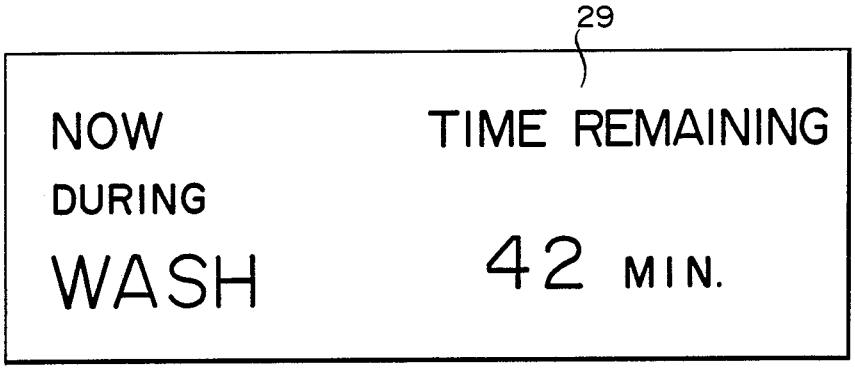
FIGS. 10, 11A and 11B are views showing patterns of display according to the third embodiment of the present invention.
Figure 11A:
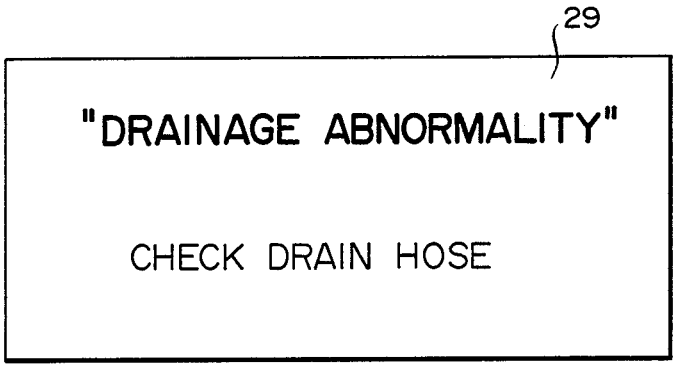
Figure 11B:
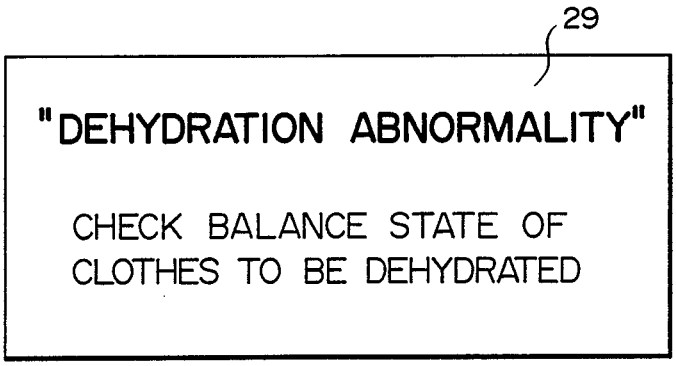

Note that in the above embodiments, the progress of the washing operation and abnormalities are displayed by the figure and character displays, but they may be displayed only by the character displays as shown in FIG. 10 and FIGS. 11A and 11B, as in a third embodiment of the present invention. In the third embodiment, liquid crystal display 29 is illustrated as a display.

In addition, the present invention is not limited to the above embodiments but many changes and modifications may be made without departing from the scope and spirit of the present invention.

As has been described above, the display apparatus of the present invention comprises a display control circuit for outputting a display signal of the progress of the washing operation and abnormalities and a display consisting of an electronic driving-type display element and driven by the display signal to display the progress of the washing operation and abnormalities. For this reason, the display apparatus of the present invention does not easily malfunction and can conveniently inform the user of any abnormalities. In addition, according to the present invention, the display content of the progress of the washing operation is not limited to a fixed operation order. As a result, when used in a washing machine in which a washing operation process can be set by a user, the display apparatus of the present invention can display the progress of the process set by the user immediately. In addition, the apparatus does not display abnormalities when there is no abnormality, so that abnormalities will not be erroneously displayed.

What is claimed is:

1. An electronic driving-type display apparatus for an electric washing machine comprising:

display control means for sequentially outputting first display data, during a washing operation by a washing machine main body, for dividing the washing operation into a predetermined number of process cycles and displaying them, and for outputting second display data when an abnormality occurs during said washing operation by the washing machine main body, for displaying said abnormality in correspondence with the process cycles; and display means, which has an electronic driving-type display including a predetermined number of patterns of display having character and figure display patterns for selectively displaying the predetermined number of process cycles and abnormality and for receiving said first and second display data from said display control means and driving the patterns of said display corresponding to said received first and second display data.

2. An apparatus according to claim 1, wherein said display of said display means is a fluorescent display.

3. An apparatus according to claim 1, wherein said display of said display means is a liquid crystal display.

4. An apparatus according to claim 1, wherein said display control means further outputs third display data, during the washing operation by said washing machine main body, for displaying a remaining time of said washing operation, and said display means further has numeral display patterns for displaying said remaining time in response to said third display data from said display control means, and for driving said numeral display patterns corresponding to said received third display data.

5. An apparatus according to claim 1, wherein said display control means further outputs fourth display data, when an abnormality occurs during the washing operation by said washing machine main body, for displaying how to cope with said abnormality, and said display means further has character display patterns for displaying how to cope with said abnormality responsive to said fourth display data from said display control means, and for driving said character display patterns corresponding to said received fourth display data.

* * * * *